US006520053B2

(12) United States Patent
Liao

(10) Patent No.: US 6,520,053 B2
(45) Date of Patent: Feb. 18, 2003

(54) ROTATABLE TOOL HANDLE HAVING A SOLID LOCKING STRUCTURE

(76) Inventor: Youn Chyuan Liao, 5F-2, No. 130, Tai Yuan North Road, Taichung (TW), 404

( * ) Notice: Subject to any disclaimer, the term of this patent is extended or adjusted under 35 U.S.C. 154(b) by 39 days.

(21) Appl. No.: 09/909,019

(22) Filed: Jul. 20, 2001

(65) Prior Publication Data

US 2003/0015071 A1 Jan. 23, 2003

(51) Int. Cl.[7] ..... B25B 23/16
(52) U.S. Cl. ..... 81/177.9; 81/177.4
(58) Field of Search ..... 81/177.8, 177.9, 81/177.4, 177.7

(56) References Cited

U.S. PATENT DOCUMENTS 943,757 A * 12/1909 Stephens ..... 81/177.9
1,144,907 A * 6/1915 Knipple ..... 81/177.9
3,270,597 A * 9/1966 Neff et al. ..... 81/177.9
4,711,145 A 12/1987 Inoue ..... 81/177.1
4,901,608 A 2/1990 Shieh ..... 81/177.8
5,280,740 A 1/1994 Ernst ..... 81/177.7
5,613,413 A * 3/1997 Huang ..... 81/177.4
6,167,787 B1 * 1/2001 Jarvis ..... 81/177.8
6,186,034 B1 * 2/2001 Lamons ..... 81/177.9
6,189,420 B1 * 2/2001 Shiao ..... 81/177.8

* cited by examiner

*Primary Examiner*—Eileen P. Morgan
*Assistant Examiner*—Joni B. Danganan

(57) ABSTRACT

A rotatable tool handle device includes a handle having a chamber for receiving a spring biased latch, a shank having one end rotatably secured to the handle with a pivot shaft and having two cavities. A latch is slidably engaged in the chamber of the handle, and guided to move relative to the handle, and has a tongue for solidly engaging into either of the cavities of the shank and for securing the shank to the handle at a selected angular position. A spring may bias the tongue of the latch to solidly engage with either of the cavities of the shank.

10 Claims, 5 Drawing Sheets

ROTATABLE TOOL HANDLE HAVING A SOLID LOCKING STRUCTURE

BACKGROUND OF THE INVENTION

1. Field of the Invention

The present invention relates to a rotatable tool handle, and more particularly to a rotatable tool handle assembly including a solid angular locking structure.

2. Description of the Prior Art

Typical rotatable tool handles comprise a driving shank or a driving head or the driving member or the like rotatably secured to a handle with a securing or locking device. U.S. Pat. No. 4,711,145 to Inoue discloses one of the typical rotatable tool handles including a moving part having one or more teeth for engaging with the peripheral teeth on the driving head member. U.S. Pat. No. 4,901,608 to Shieh discloses a similar typical rotatable tool handle including a gear for engaging with the peripheral teeth on the driving head member. U.S. Pat. No. 5,280,740 to Ernst discloses another similar typical rotatable tool handle including a spring biased ball or a spring biased projection for engaging with the peripheral cavities on the driving head member. The lock devices may not be used for solidly securing the driving head member to the handle such that the driving tool member may be rotated relative to the handle inadvertently.

The present invention has arisen to mitigate and/or obviate the afore-described disadvantages of the conventional rotatable tool handles.

SUMMARY OF THE INVENTION

The primary objective of the present invention is to provide a rotatable tool handle assembly including a solid angular locking structure for selectively and solidly locking the driving shank to the handle at any selected relative angular position.

In accordance with one aspect of the invention, there is provided a rotatable tool handle assembly comprising a handle including a chamber formed therein, a shank including a first end rotatably received in the chamber of the handle and rotatably secured to the handle with a pivot shaft, the first end of the shank including a peripheral portion having at least one cavity formed therein, and a latch slidably engaged in the chamber of the handle, and including a tongue for engaging into the cavity of the shank and for securing the shank to the handle at a selected angular position.

A device is further provided for guiding the latch to move relative to the handle and to move toward and away from the shank, and includes a channel formed in the latch, and a guide rod extended from the handle and extended inward of the chamber of the handle for slidably engaging into the channel of the latch.

The guiding means includes a first flat surface formed in the handle, and a second flat surface formed in the latch and slidably engaging with the first flat surface of the handle.

The latch includes a knob for moving the latch relative to the handle and for moving the latch toward and away from the shank. The knob includes a knurled surface for facilitating a movement of the knob and the latch relative to the handle.

A spring biasing device may further be provided for biasing the tongue of the latch to engage with the cavity of the shank.

The handle includes an aperture formed therein and communicating with the chamber thereof, the shank includes an orifice formed therein, the pivot shaft includes a shaft body engaged through the orifice of the shank and the aperture of the handle for rotatably securing the shank to the handle.

The shaft body includes a first end having an enlarged head for engaging with the handle, and including a second end.

The handle includes a pair of recesses formed therein and communicating with the aperture thereof, and a pair of panels engaged in the recesses of the handle for blocking and shielding the enlarged head and the second end of the shaft body.

The shank includes at least one projection extended therefrom and defined by the cavity thereof, the handle includes a protrusion extended inward of the chamber thereof and having a shoulder formed therein for receiving the projection and for positioning the shank to the handle.

The handle includes a rear end having a space formed therein, and having an inner thread formed therein, and a cap including an outer thread for threading with the inner thread of the handle and including a plurality of sockets provided therein for supporting tool members.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
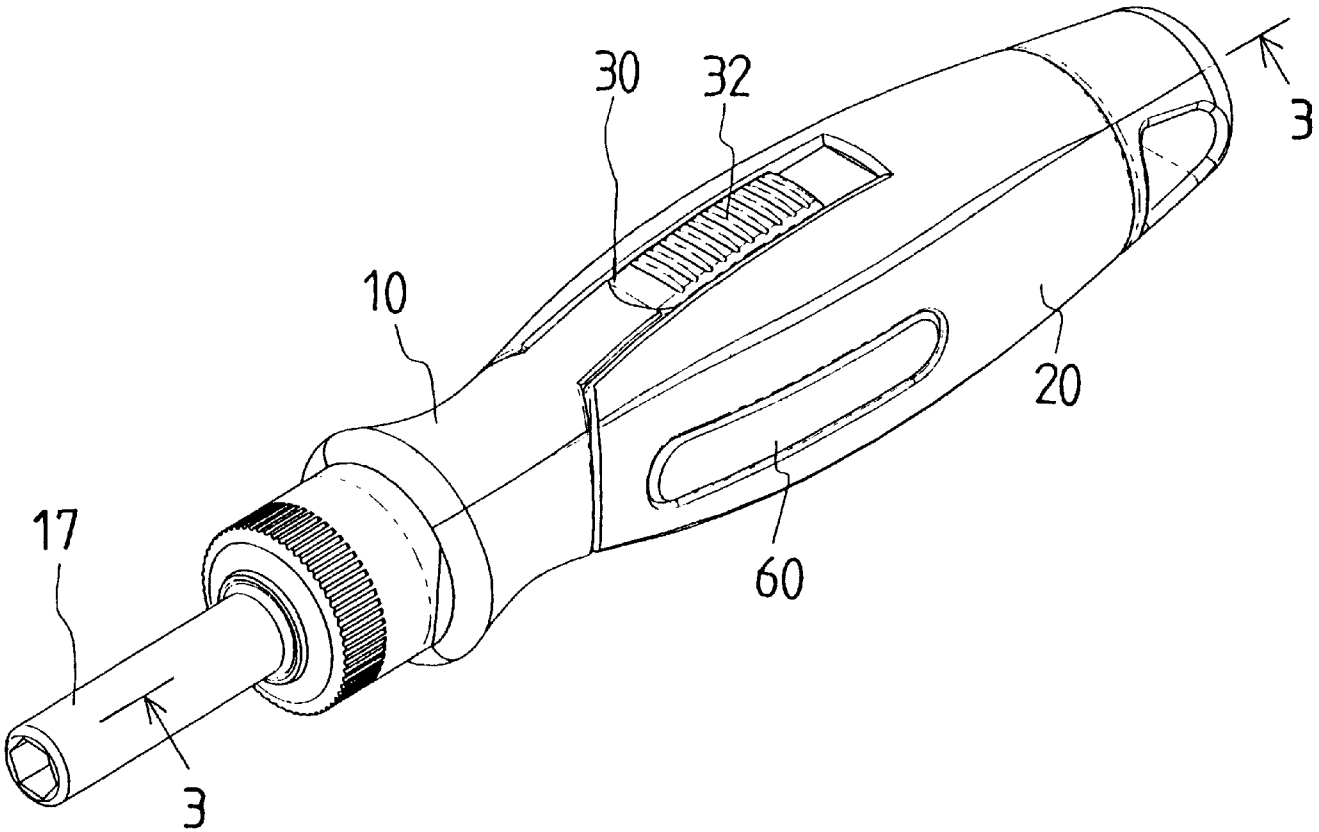
FIG. 1 is a perspective view of a rotatable tool handle assembly in accordance with the present invention.
Figure 2:
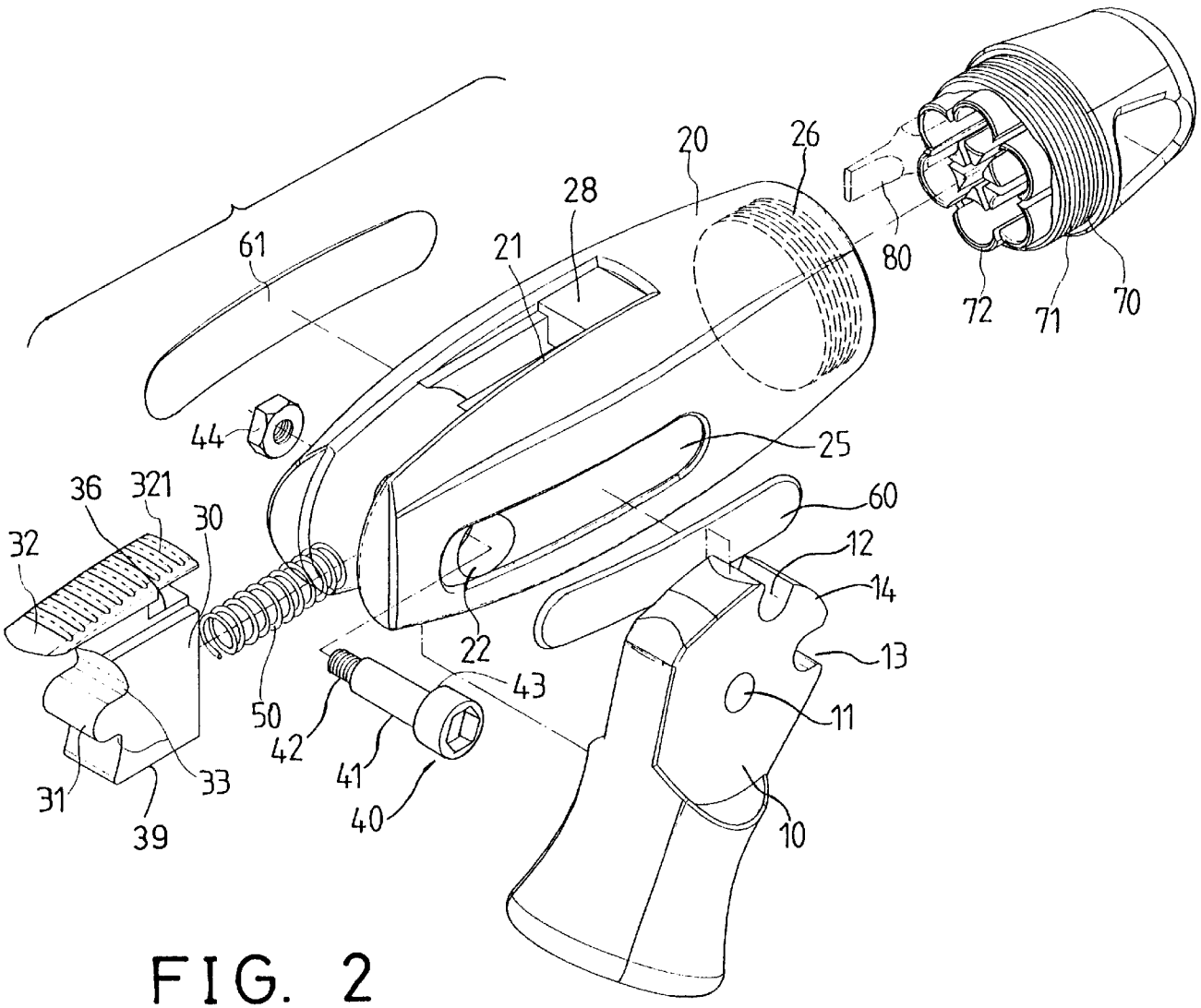
FIG. 2 is an exploded view of the rotatable tool handle assembly.
Figure 3:
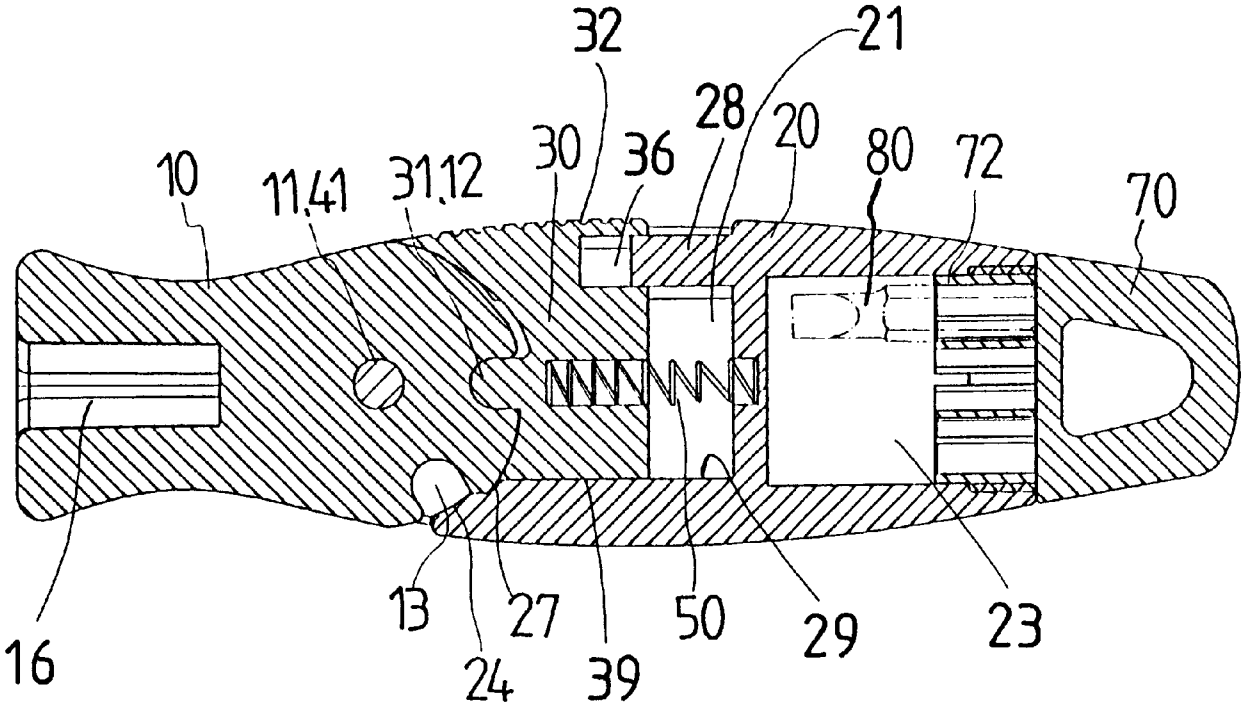
FIG. 3 is a partial cross sectional view taken along lines 3—3 of FIG. 1.

Referring to the drawings, and initially to FIGS. 1–3, a rotatable tool handle assembly in accordance with the present invention comprises a handle 20 including a chamber 21 formed therein, such as formed in the front portion thereof, and defined by a flat bottom surface 29 (FIGS. 3, 4), and including a guide rod 28 extended inward of the chamber 21 thereof, such as extended inward from the upper portion of the handle 20. The handle 20 includes a space 23 formed therein, such as formed in the rear portion thereof for receiving tool bits 80 or the like, and includes an inner thread 26 formed in the rear portion thereof. A cap 70 includes an outer thread 71 formed thereon for threading with the inner thread 26 of the handle 20, and includes one or more sockets 72 provided therein for receiving and supporting the tool bits 80 or the like. The handle 20 includes an aperture 22 laterally formed therein and intersecting or communicating with the chamber 21 thereof, and includes two recesses 25 formed in the opposite sides thereof and communicating with the aperture 22 thereof.

A shank, such as a driving shank 10 includes a rear portion rotatably received in the chamber 21 of the handle 20, and includes an orifice 11 formed in the rear portion thereof for aligning with the aperture 22 of the handle 20. A pivot shaft 40 includes a shaft body 41 engaged through the aperture 22 of the handle 20 and the orifice 11 of the shank 10 for rotatably securing the shank 10 to the handle 20. The shaft body 41 includes an enlarged head 43 for engaging with the handle 20 and for preventing the pivot shaft 40 from being disengaged from the handle 20. A lock nut 44 is engaged with an outer thread 42 of the shaft body 41 for locking the pivot shaft 40 to the handle 20. Two bars or panels 60, 61 may be engaged into the recesses 25 of the handle 20 for shielding the enlarged head 43 and the lock nut 44. The shank 10 includes a rear peripheral portion having one or more cavities 12, 13 formed therein and formed around the orifice 11 of the shank 10, and having one or more projections 14 formed or defined between the cavities 12, 13 of the shank 10. The shank 10 includes an engaging hole 16 formed in the front portion thereof for receiving and driving the tool bit 80 or the like.

Figure 4:
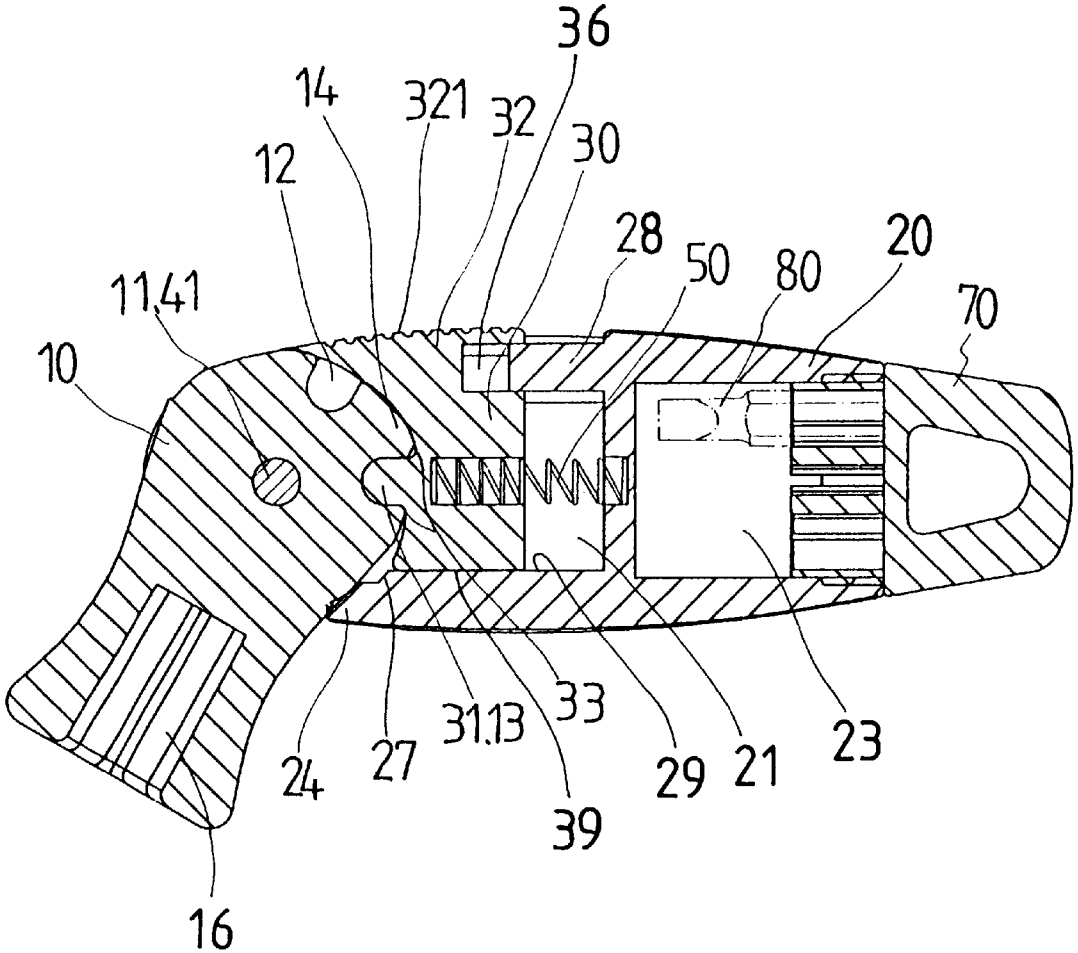
FIG. 4 is a partial cross sectional view similar to FIG. 3, illustrating the operation of the rotatable tool handle assembly.
Figure 5:
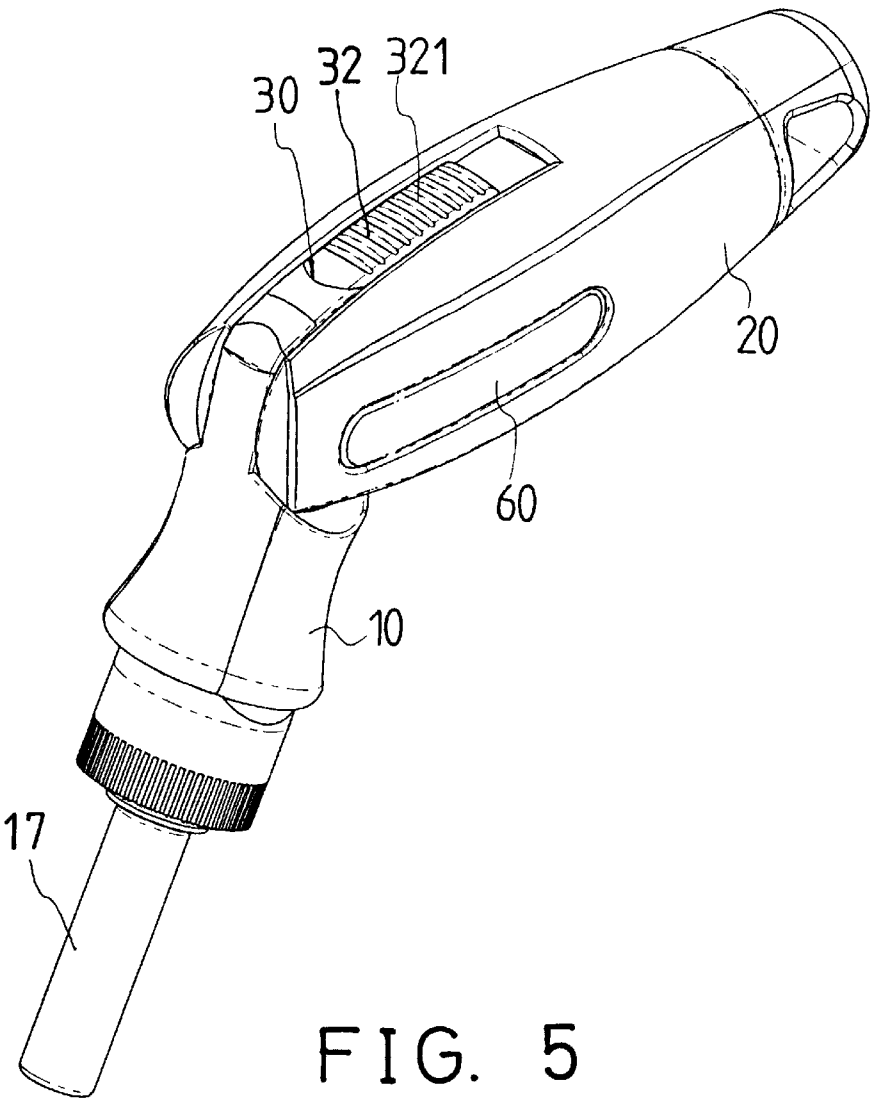
FIG. 5 is a perspective view of the rotatable tool handle assembly as shown in FIG. 4, illustrating the operation of the rotatable tool handle assembly.

A latch 30 is slidably received in the chamber 21 of the handle 20, and includes a channel 36 formed therein for slidably receiving the guide rod 28 of the handle 20 for guiding the latch 30 to move forward and rearward in the chamber 21 of the handle 20, and includes a flat bottom surface 39 for slidably engaging with the flat bottom surface 29 of the handle 20 and for further stably guiding the latch 30 to move forward and rearward relative to the handle 20. The latch 30 includes a tongue 31 extended forward therefrom and formed or defined by two depressions 33 thereof, for engaging into either of the cavities 12, 13 of the shank 10 and for locking the shank 10 to the handle 20 at the selected or required angular position. A spring 50 is engaged between the handle 20 and the latch 30 for biasing the tongue 31 of the latch 30 to engage into either of the cavities 12, 13 of the shank 10 (FIGS. 3, 4).

The latch 30 includes a knob 32 provided on top thereof and flush with the upper portion or the upper surface of the handle 20 and having a knurled surface 321 or the like for allowing the latch 30 to be moved forward and rearward relative to the handle 20 by the knob 32. The tongue 31 of the latch 30 may thus be solidly engaged into either of the cavities 12, 13 of the shank 10 for solidly securing the shank 10 to the handle 20 at the required or selected angular position. The handle 20 includes a protrusion 24 extended or formed or provided in the bottom and front portion thereof and having a shoulder 27 formed therein for receiving the projection 14 of the shank 10 and for further solidly positioning the shank 10 to the handle 20.

In operation, as shown in FIGS. 1 and 3–5, the shank 10 may be rotated relative to the handle 20 to any selected or required angular position when the tongue 31 of the latch 30 is disengaged from the shank 10 by moving the knob 32 of the latch 30 away from the shank 10. When the shank 10 has been rotated relative to the handle 20 to the selected or required angular position, the tongue 31 of the latch 30 may be biased by the spring 50 to engage into either of the cavities 12, 13 of the shank 10 again, in order to solidly secure the shank 10 to the handle 20 at the required or selected angular position.

Accordingly, the rotatable tool handle assembly in accordance with the present invention includes a solid angular locking structure for selectively and solidly locking the driving shank to the handle at any selected relative angular position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rotatable tool handle assembly comprising:

a handle including a chamber formed therein, a shank including a first end rotatably received in said chamber of said handle and rotatably secured to said handle with a pivot shaft, said first end of said shank including a peripheral portion having at least one cavity formed therein, a latch slidably engaged in said chamber of said handle, and including a tongue for engaging into said at least one cavity of said shank and for securing said shank to said handle at a selected angular position, and means for guiding said latch to move relative to said handle and to move toward and away from said shank, said guiding means including a channel formed in said latch, and a guide rod extended from said handle and extended inward of said chamber of said handle for slidably engaging into said channel of said latch.

2. The rotatable tool handle assembly according to claim 1 wherein said guiding means includes a first flat surface formed in said handle, and a second flat surface formed in said latch and slidably engaging with said first flat surface of said handle.

3. The rotatable tool handle assembly according to claim 1, wherein said latch includes a knob for moving said latch relative to said handle and for moving said latch toward and away from said shank.

4. The rotatable tool handle assembly according to claim 3, wherein said knob includes a knurled surface for facilitating a movement of said knob and said latch relative to said handle.

5. The rotatable tool handle assembly according to claim 1 further comprising means for biasing said tongue of said latch to engage with said at least one cavity of said shank.

6. The rotatable tool handle assembly according to claim 1, wherein said handle includes an aperture formed therein and communicating with said chamber thereof, said shank includes an orifice formed therein, said pivot shaft includes a shaft body engaged through said orifice of said shank and said aperture of said handle for rotatably securing said shank to said handle.

7. The rotatable tool handle assembly according to claim 1, wherein said handle includes a rear end having a space formed therein, and having an inner thread formed therein, and a cap including an outer thread for threading with said inner thread of said handle and including a plurality of sockets provided therein for supporting tool members.

8. A rotatable tool handle assembly comprising:

a handle including a chamber formed therein, and including an aperture formed therein and communicating with said chamber thereof, a shank including a first end rotatably received in said chamber of said handle and rotatably secured to said handle with a pivot shaft, said first end of said shank including a peripheral portion having at least one cavity formed therein, said shank including an orifice formed therein, said pivot shaft including a shaft body engaged through said orifice of said shank and said aperture of said handle for rotatably securing said shank to said handle, said shaft body including a first end having an enlarged head for engaging with said handle, and including a second end, and a latch slidably engaged in said chamber of said handle, and including a tongue for engaging into said at least one cavity of said shank and for securing said shank to said handle at a selected angular position.

9. The rotatable tool handle assembly according to claim 8, wherein said handle includes a pair of recesses formed therein and communicating with said aperture thereof, and a pair of panels engaged in said recesses of said handle for blocking and shielding said enlarged head and said second end of said shaft body.

10. A rotatable tool handle assembly comprising:

a handle including a chamber formed therein, a shank including a first end rotatably received in said chamber of said handle and rotatably secured to said handle with a pivot shaft, said first end of said shank including a peripheral portion having at least one cavity formed therein, said shank including at least one projection extended therefrom and defined by said at least one cavity thereof, said handle including a protrusion extended inward of said chamber thereof and having a shoulder formed therein for receiving said at least one projection and for positioning said shank to said handle, and a latch slidably engaged in said chamber of said handle, and including a tongue for engaging into said at least one cavity of said shank and for securing said shank to said handle at a selected angular position.

* * * * *